US009573254B2

(12) United States Patent
Bartoszek

(10) Patent No.: US 9,573,254 B2
(45) Date of Patent: Feb. 21, 2017

(54) IMPACT TOOLS

(71) Applicant: Ingersoll-Rand Company, Davidson, NC (US)

(72) Inventor: Jason Christopher Bartoszek, Bethlehem, PA (US)

(73) Assignee: Ingersoll-Rand Company, Davidson, NC (US)

( * ) Notice: Subject to any disclaimer, the term of this patent is extended or adjusted under 35 U.S.C. 154(b) by 543 days.

(21) Appl. No.: 14/109,830

(22) Filed: Dec. 17, 2013

(65) Prior Publication Data

US 2015/0165604 A1 Jun. 18, 2015

(51) Int. Cl.
*B25B 21/02* (2006.01)
*B25B 23/147* (2006.01)

(52) U.S. Cl.
CPC ..... *B25B 21/02* (2013.01); *B25B 23/1475* (2013.01)

(58) Field of Classification Search
CPC ..... B25B 21/02; B25D 11/04
USPC ..... 173/1, 2, 93.5, 176, 104
See application file for complete search history.

(56) References Cited

U.S. PATENT DOCUMENTS 7,011,165 B2 3/2006 Kristen et al.
7,410,006 B2 8/2008 Zhang et al.
7,481,764 B2 1/2009 Soutorine et al.
7,673,702 B2 3/2010 Johnson et al.
7,806,201 B2 10/2010 Aoki
8,087,472 B2 1/2012 Usselman et al.
8,413,742 B2 4/2013 Ikuta et al.
2002/0060082 A1* 5/2002 Watanabe ..... B25B 21/02 173/176
2009/0250233 A1* 10/2009 Wallace ..... B25B 23/1405 173/1
2010/0276168 A1 11/2010 Murthy et al.
2010/0326686 A1 12/2010 Leong et al.
2011/0303729 A1 12/2011 Hahn et al.
2011/0315417 A1* 12/2011 Matsunaga ..... B25B 21/008 173/176
2012/0279736 A1 11/2012 Tanimoto et al.
(Continued)

FOREIGN PATENT DOCUMENTS

EP 1607186 A1 12/2005

OTHER PUBLICATIONS

PHD, Inc., "Series KG Impact Sensor & Programmer," 2 pages.
Makita U.S.A., "18V LXT Lithium-Ion Brushless Quick-Shirft Mode 3-Speed Impact Driver Kit," 2 pages.

*Primary Examiner* — Nathaniel Chukwurah
(74) *Attorney, Agent, or Firm* — Barnes & Thornburg LLP

(57) ABSTRACT

In at least one illustrative embodiment, an impact tool may comprise an impact mechanism including a hammer and an anvil. The hammer may be configured to rotate about an axis and to translate along the axis to impact the anvil to cause rotation of the anvil about the axis. The impact tool may further comprise a motor, a drive train, an inertial sensor, and an electronic controller. The drive train may be configured to transfer rotation from the motor to the hammer of the impact mechanism. The inertial sensor may be configured to sense an acceleration of the drive train along the axis. Further, the electronic controller may be operably coupled to the motor and to the inertial sensor and configured to decrease a rotational speed of the motor in response to determining that the acceleration of the drive train has exceeded a threshold acceleration.

13 Claims, 3 Drawing Sheets

(56) References Cited

U.S. PATENT DOCUMENTS

| | | | | |
|---|---|---|---|---|
| 2012/0279742 | A1* | 11/2012 | Roser | B25F 5/00<br>173/176 |
| 2013/0133911 | A1 | 5/2013 | Ishikawa et al. | |
| 2013/0133913 | A1 | 5/2013 | Magali et al. | |

* cited by examiner

IMPACT TOOLS

TECHNICAL FIELD

The present disclosure relates, generally, to impact tools and, more particularly, to impact tools having vibration reduction control.

BACKGROUND

An impact wrench is one illustrative embodiment of an impact tool, which may be used to install and remove threaded fasteners. An impact wrench generally includes a motor coupled to an impact mechanism that converts the torque of the motor into a series of powerful rotary blows (i.e., impacts) directed from one or more hammers to an anvil coupled to an output shaft. In a ball-and-cam type impact mechanism, the hammer both rotates about an axis and translates along that axis to impact the anvil. The translation of the hammer (and, hence, the timing of the impacts with the anvil) is mechanically controlled by one or more balls disposed in cam grooves formed between the hammer and a camshaft, as well as a spring that biases the hammer. After each impact with the anvil, the hammer rebounds rotationally around the axis and also translates backward along the axis due to the ball(s) and cam groove(s).

In a typical ball-and-cam impact mechanism, the design and size of the components (e.g., the spring, balls, and camshaft grooves) are often critical to efficient operation across a broad range of joints. For example, impact tools designed to operate on soft joints (i.e., low rebound applications where the majority of the impacting energy is transferred into the joint) often result in significant vibration of the impact tool when operating on hard joints (i.e., high rebound applications) due to the motor operating at higher speeds. Conversely, impact tools designed to operate on hard joints often perform inadequately on soft joints due to the motor operating at lower speeds.

SUMMARY

According to one aspect, an impact tool may comprise an impact mechanism comprising a hammer and an anvil, the hammer being configured to rotate about an axis and to translate along the axis to impact the anvil to cause rotation of the anvil about the axis, a motor, a drive train configured to transfer rotation from the motor to the hammer of the impact mechanism, an inertial sensor configured to sense an acceleration of the drive train along the axis, and an electronic controller operably coupled to the motor and to the inertial sensor. The electronic controller may be configured to decrease a rotational speed of the motor in response to determining that the acceleration of the drive train along the axis has exceeded a threshold acceleration.

In some embodiments, the inertial sensor may be coupled to the drive train. The inertial sensor may be coupled to a ring gear holder of a planetary gear set of the drive train. One or more ball bearings may couple the hammer to a camshaft for rotation therewith, and the inertial sensor may be coupled to the camshaft.

In some embodiments, the electronic controller may be configured to determine whether the hammer has impacted the drive train based on the acceleration of the drive train along the axis. The electronic controller may be further configured to increase the rotational speed of the motor in response to determining that the acceleration of the drive train along the axis has not exceeded the threshold acceleration for a predetermined period of time. The electronic controller may be configured to determine whether the acceleration of the drive train along the axis has exceeded the threshold acceleration on a periodic basis.

According to another aspect, a method of operating an impact tool may comprise rotating a hammer of the impact tool about an axis to cause the hammer to translate along the axis in a first direction to impact an anvil of the impact tool, thereby causing rotation of the anvil about the axis and reducing a rotational speed of the hammer in response to a distance that the hammer has rebounded in a second direction after impacting the anvil exceeding a threshold distance, the second direction being opposite the first direction.

In some embodiments, the method may further comprise determining, using an electronic controller, whether the distance that the hammer has rebounded exceeds the threshold distance. Determining whether the distance that the hammer has rebounded exceeds the threshold distance may comprise sensing, with an inertial sensor, an acceleration of a drive train of the impact tool along the axis.

In some embodiments, the method may further comprise sensing, with a linear encoder, the distance that the hammer has rebounded. The method may further comprise sensing, with an optical sensor, whether the distance that the hammer has rebounded exceeds the threshold distance. The method may further comprise sensing, with a limit switch, whether the distance that the hammer has rebounded exceeds the threshold distance.

In some embodiments, the method may further comprise increasing the rotational speed of the hammer, after previously reducing the rotational speed of the hammer, in response to determining that the distance the hammer has rebounded has not exceeded the threshold distance for a predetermined period of time.

According to yet another aspect, an impact tool may comprise an impact mechanism comprising a hammer and an anvil, the hammer being configured to (i) rotate about an axis, (ii) translate along the axis in a first direction to impact the anvil to cause rotation of the anvil about the axis, and (iii) rebound in a second direction, opposite the first direction, as a result of the impact, a motor configured to drive rotation of the hammer of the impact mechanism, a position sensor configured to sense a position of the hammer along the axis, and an electronic controller coupled to the motor and to the position sensor. The electronic controller may be configured to decrease a rotational speed of the motor in response to the hammer rebounding beyond a predetermined location along the axis.

In some embodiments, the impact tool may further comprise a spring configured to bias the hammer toward the first direction. The predetermined location along the axis corresponds with a predetermined amount of compression of the spring. The hammer may be configured to rebound beyond the predetermined location along the axis when a rebound force applied to the spring by the hammer exceeds a biasing force applied to the hammer by the spring with the predetermined amount of compression.

In some embodiments, the electronic controller may be configured to determine the location of the hammer relative to the predetermined location along the axis based on the sensed position of the hammer. The impact tool may further comprise a drive train configured to transfer rotation from the motor to the hammer, and the predetermined location along the axis may correspond with a location at which the hammer impacts the drive train.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 1A:
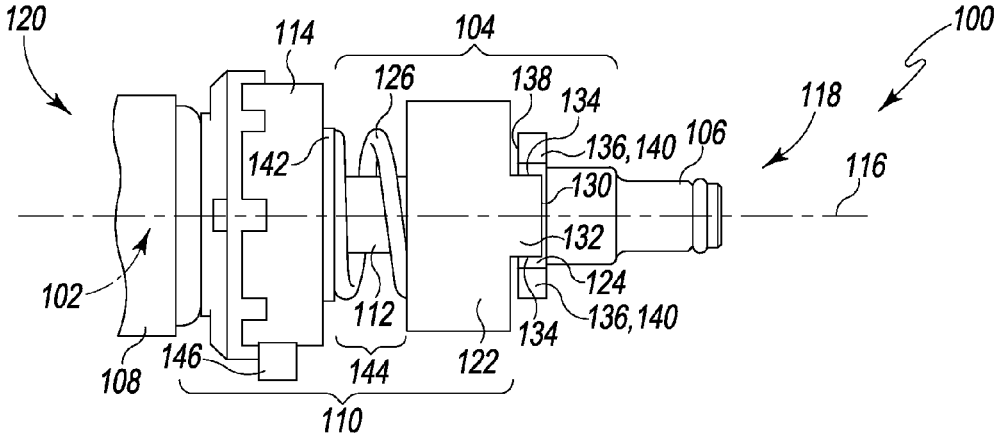
FIG. 1A is a profile view of selected components of an illustrative impact tool, showing a hammer of the impact tool impacting an anvil of the impact tool.
Figure 1B:
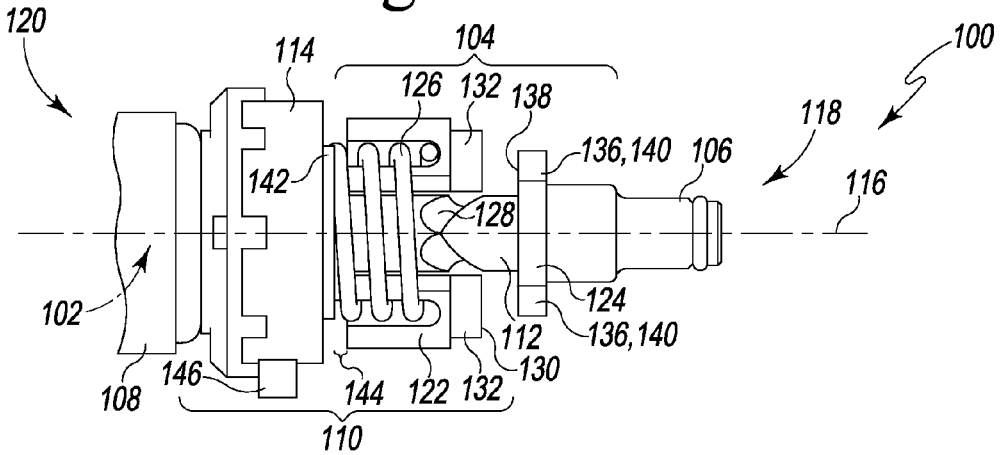
FIG. 1B is a partial cross-sectional view of the selected components of the impact tool of FIG. 1A, showing the hammer rebounded to an acceptable distance after impacting the anvil.
Figure 1C:
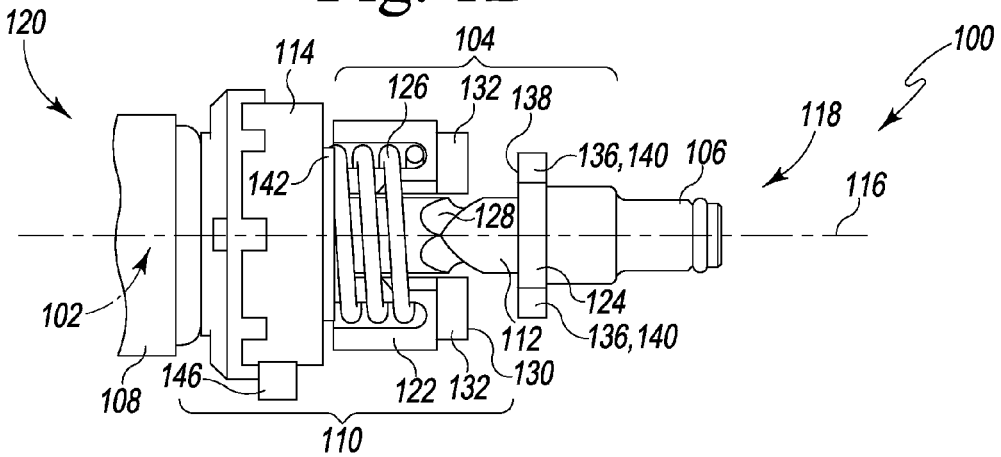
FIG. 1C is a partial cross-sectional view of the selected components of the impact tool of FIG. 1A, showing the hammer rebounded to an unacceptable distance after impacting the anvil.

Referring generally to FIGS. 1A-C, profile and partial cross-sectional views of selected components of one illustrative embodiment of an impact tool 100 are shown. In particular, FIG. 1A shows a profile view of a ball-and-cam impact mechanism 104 of the impact tool 100 (along with related components), while FIGS. 1B and 1C are partial cross-sectional views in which only the hammer 122 is shown in cross section (i.e., all other components are shown in profile). As described in detail below, the impact tool 100 of the present disclosure is able to effectively operate on both hard and soft joints without compromising between the two types of joints. More specifically, the impact tool 100 may utilize a motor 102 configured to operate at speeds that would typically be too powerful for hard joint applications. For example, the motor may operate at a peak or high speed on soft joints to provide sufficient driving force and at a reduced speed on hard joints to reduce or eliminate excessive vibrations of the impact tool 100.

As suggested in FIGS. 1A-C, the motor 102 of the impact tool 100 is configured to drive rotation of the ball-and-cam impact mechanism 104 and thereby drive rotation of an output shaft 106. The motor 102 is illustratively embodied as an electric motor 102 positioned within a motor housing 108 and coupled to a source of electricity (e.g., mains electricity or a battery). However, in other embodiments, the motor 102 may be embodied as any suitable prime mover including, for example, a pneumatic motor coupled to a source of pressurized fluid (e.g., an air compressor).

The impact tool 100 includes a drive train 110 operably coupled to the motor 102 and the impact mechanism 104. In the illustrative embodiment, the drive train 110 includes a camshaft 112 and one or more gears (not shown) housed within a gear carrier 114. In FIGS. 1A-C, the gear carrier 114 is illustratively embodied as a ring gear holder 114 of a planetary gear set of the drive train 110. Depending on the particular embodiment, the gears may include, for example, ring gears, planetary gear sets, spur gears, bevel gears, or any combination thereof configured to transfer torque from the motor 102 to the camshaft 112 and thereby drive rotation of the camshaft 112. The camshaft 112 is positioned along a longitudinal axis 116 of the impact tool 100. As illustratively shown, the longitudinal axis 116 extends from a front end 118 of the impact tool 100 to a rear end 120 of the impact tool 100. In the illustrative embodiment of FIGS. 1A-C, the motor 102 is configured to drive rotation of the camshaft 112 about the longitudinal axis 116.

In the illustrative embodiment of FIGS. 1A-C, the ball-and-cam impact mechanism 104 generally includes a hammer 122, an anvil 124, and a spring 126. The camshaft 112 passes through an opening in the hammer 122 (e.g., at the center of the hammer 122). The camshaft 112 includes a pair of helical grooves 128 and the hammer 122 includes a pair of corresponding helical grooves (not shown). In the illustrative embodiment, ball bearings (not shown) are positioned in the helical grooves 128 and the corresponding helical grooves of the hammer 122 to couple the camshaft 112 to the hammer 122. The hammer 122 is rotatable over the ball bearings and is driven for rotation about the longitudinal axis 116 by the rotation of the camshaft 112. The hammer 122, in turn, drives rotation of the anvil 124 about the longitudinal axis 116 (i.e., in response to the hammer 122 impacting the anvil 124). It will be appreciated that the shape, location, and number of the bearings in the impact tool 100 may vary depending on the particular embodiment.

As indicated above, the hammer 122 is rotatable about the longitudinal axis 116 and is configured to impact the anvil 124 (i.e., when in the position shown in FIG. 1A), thereby driving rotation of the anvil 124 about the longitudinal axis 116. In some embodiments, the anvil 124 may be integrally formed with the output shaft 106. In other embodiments, the anvil 124 and the output shaft 106 may be formed separately and coupled to one another (e.g., by a press fit, taper fit, or other fastening mechanism). In such embodiments, the output shaft 106 is configured to rotate as a result of the corresponding rotation of the anvil 124. The output shaft 106 is configured to mate with interchangeable sockets (e.g., for use in tightening and loosening fasteners, such as bolts). The motor 102, the drive train 110, and the impact mechanism 104 (which includes the hammer 122 and the anvil 124) are adapted to rotate the output shaft 106 in both clockwise and counterclockwise directions, for tightening and loosening various fasteners.

The hammer 122 includes a forward impact face 130 facing a front end 118 of the impact tool 100. A pair of hammer jaws 132 extends forward from the forward impact face 130 of the hammer 122. Each of the hammer jaws 132, which may be integrally formed with the hammer 122, includes impact surfaces configured to impact corresponding impact surfaces 136 of the anvil 124 (i.e., depending on clockwise or counterclockwise rotation of the hammer 122). In some embodiments, the impact surfaces 134 of the hammer jaws 132 are generally perpendicular to the forward impact face 130 of the hammer 122 but, in other embodiments, one or more of the impact surfaces 134 may be otherwise suitably shaped (e.g., at an acute or obtuse angle the forward impact face 130). Although the illustrative embodiment of the hammer 122 includes two hammer jaws 132, any suitable number of hammer jaws 132 may be utilized in other embodiments.

The anvil 124, which may be integrally formed with the output shaft 106, includes a rearward impact face 138 facing the rear end 120 of the impact tool 100. The rearward impact face 138 includes a pair of lugs 140 extending radially outward from the output shaft 106. Each of the lugs 140, which may be integrally formed with the anvil 124, includes an impact surface 136 for receiving an impact blow from the hammer jaws 132 of the hammer 122. The impact surfaces 136 may be generally perpendicular to the rearward impact face 138 or otherwise suitably shaped (e.g., at an acute or obtuse angle the rearward impact face 138). While the illustrative embodiment of the anvil 124 includes two lugs 140, any suitable number of lugs 140 may be utilized.

The spring 126 is disposed around the camshaft 112 to bias the hammer 122 toward the anvil 124. In the illustrative embodiment, the camshaft 112 includes a cylindrical flange 142 at its base (near the gear carrier 114) for maintaining the spring 126 in proper engagement with the hammer 122. Although the cylindrical flange 142 is shown as being integral with the camshaft 112 in the illustrative embodiment, the cylindrical flange 142 may be a separate component sandwiched between the gear carrier 114 and the spring 126 in other embodiments.

During operation, as the hammer 122 rotates, the spring 126 moves the hammer 122 along the helical grooves 128 of the camshaft 112 and toward the front end 118 of the impact tool 100. It will be appreciated that the spring 126 moves the hammer 122 toward the anvil 124 by virtue of applied spring forces of the compressed spring 126 after the hammer 122 has completed a prior rebound (i.e., the conversion of potential energy stored in the compressed spring 126 into kinetic energy). When the hammer 122 has moved toward the front end 118 of the impact tool 100, continued rotation of the hammer 122 will result in the hammer jaws 132 impacting the lugs 140 to transfer rotational torque from the hammer 122 to the anvil 124.

After the hammer 122 impacts the anvil 124, the hammer 122 rebounds from the anvil 124 toward the rear end 120 of the impact tool 100. During this rebound, the hammer jaws 132 of the hammer 122 are separated from the lugs 140 of the anvil 124 so that the hammer jaws 132, 140 do not contact one another, despite relative rotation of the hammer 122 and the anvil 124. Additionally, as the hammer 122 is driven backward toward the drive train 110, as illustrated in FIGS. 1B-C, the spring 126 is compressed and the clearance 144 between the hammer 122 and the gear carrier 114 is diminished. It should be appreciated that the location of the hammer 122 along the longitudinal axis 116—or, more specifically, along the camshaft 112—corresponds with a particular amount of compression and stored energy of the spring 126.

In operation, the spring 126 may not be able to store the energy required to stop the rearward motion of the rebounding hammer 122 along the longitudinal axis 116. In other words, the rebound force applied to the spring 126 by the hammer 122 may exceed the biasing force applied to the hammer 122 by the spring 126 as a result of compression of the spring 126. In those circumstances, the hammer 122 effectively crashes into (i.e., impacts) the one or more components of the drive train 110 of the impact tool, such as the gear carrier 114, the cylindrical flange 142, or the spring 126 (see FIG. 1C). This impact generates vibrations (e.g., from axial acceleration) in the impact tool 100, which may be uncomfortable to a user. As discussed in greater detail below, the impact tool 100 is configured to reduce a rotational speed of the motor 102 and thereby reduce the rotational speed of the hammer 122 in response to detecting, for example, axial vibrations of the impact tool 100.

The impact tool 100 includes one or more sensors 146 configured to sense, directly or indirectly, a location of the hammer 122 along the camshaft 112 and/or acceleration of one or more components of the impact tool 100 along (or parallel to) the longitudinal axis 116. As shown in the illustrative embodiment of FIGS. 1A-C, one or more of the sensors 146 may be coupled to the gear carrier 114 of the impact tool 100. It will be appreciated that, in other embodiments, the sensors 146 may be positioned elsewhere in or on the impact tool 100. By way of example, a sensor 146 may be coupled to another portion of the drive train 110 or to the motor housing 108.

In the illustrative embodiment, the one or more sensors 146 are configured to generate data that may be used by an electronic controller 202 of the impact tool 100 to determine when to reduce the rotational speed of the motor 102 and, hence, the hammer 122. Specifically, the one or more sensors 146 may be configured to sense, for example, the location of the hammer 122 and/or acceleration of the impact tool 100 along the longitudinal axis 116, depending on the particular embodiment. As such, the one or more sensors 146 may include, for example, proximity sensors, optical sensors, light sensors, motion sensors, inertial sensors, linear encoders, limit switches, and/or other types of sensors. It should be appreciated that the foregoing examples are merely illustrative and should not be seen as limiting the sensors 146 to any particular type of sensor. As discussed below, once the controller 202 determines that the hammer 122 has impacted the drive train 110 or has otherwise caused erratic motion, the controller 202 may instruct the motor 102 (e.g., via electrical signals sent to the motor 102) to reduce its speed which, in turn, reduces the rotational speed of the hammer 122.

Figure 2:
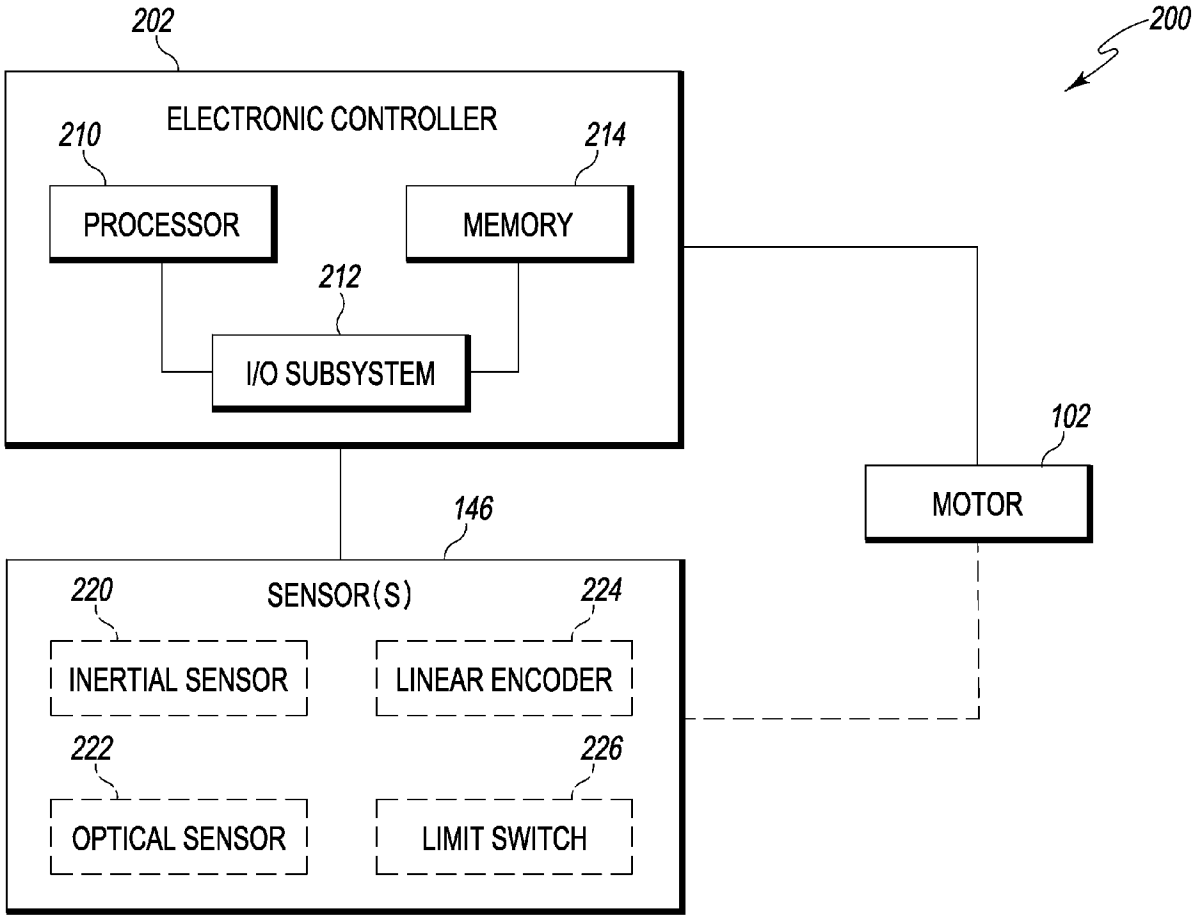
FIG. 2 is a simplified block diagram of one embodiment of a control system of the impact tool of FIGS. 1A-C.

Referring now to FIG. 2, the impact tool 100 includes an electronic control system 200. It should be appreciated that certain mechanical and electromechanical components of the impact tool 100 have not been shown in FIGS. 1 and 2 for clarity. The control system 200 generally includes the electronic controller 202, the sensor(s) 146, and the motor 102. In the illustrative embodiment, the controller 202 constitutes part of the impact tool 100 and is communicatively coupled to the sensor(s) 146 and the motor 102 of the impact tool 100 via one or more wired connections. In other embodiments, the controller 202 may be separate from the impact tool 100 and/or may be communicatively coupled to sensors 146 and the motor 102 via other types of connections (e.g., wireless or radio links). The controller 202 is, in essence, the master computer responsible for interpreting signals sent by the sensor(s) 146 of the impact tool 100 and for activating, energizing, or otherwise control the operation of electronically-controlled components associated with the impact tool 100 (e.g., the motor 102). In particular, as will be described in more detail below (with reference to FIG. 3), the controller 202 is operable to determine when to decrease/increase the rotational speed of the hammer 122 (e.g., by decreasing/increasing the speed of the motor 102).

To do so, the controller 202 includes a number of electronic components commonly associated with electronic controllers utilized in the control of electromechanical systems. In the illustrative embodiment, the controller 202 of the impact tool 100 includes a processor 210, an input/output ("I/O") subsystem 212, and a memory 214. It will be appreciated that the controller 202 may include additional or different components, such as those commonly found in a computing device. Additionally, in some embodiments, one or more of the illustrative components of the controller 202 may be incorporated in, or otherwise form a portion of, another component of the controller 202 (e.g., as with a microcontroller).

The processor 210 of the controller 202 may be embodied as any type of processor(s) capable of performing the functions described herein. For example, the processor 210 may be embodied as one or more single or multi-core processors, digital signal processors, microcontrollers, or other processors or processing/controlling circuits. Similarly, the memory 214 may be embodied as any type of volatile or non-volatile memory or data storage device capable of performing the functions described herein. The memory 214 stores various data and software used during operation of the controller 202, such as operating systems, applications, programs, libraries, and drivers. For instance, the memory 214 may store instructions in the form of a software routine (or routines) which, when executed by the processor 210, allows the controller 202 to control operation of the impact tool 100.

The memory 214 is communicatively coupled to the processor 210 via the I/O subsystem 212, which may be embodied as circuitry and/or components to facilitate I/O operations of the controller 202. For example, the I/O subsystem 212 may be embodied as, or otherwise include, memory controller hubs, I/O control hubs, firmware devices, communication links (e.g., point-to-point links, bus links, wires, cables, light guides, printed circuit board traces, etc.), and/or other components and subsystems to facilitate the I/O operations. In the illustrative embodiment, the I/O subsystem 212 includes an analog-to-digital ("A/D") converter, or the like, that converts analog signals from the sensors 146 of the impact tool 100 into digital signals for use by the processor 210. It should be appreciated that, if any one or more of the sensors 146 associated with the impact tool 100 generate a digital output signal, the A/D converter may be bypassed. Similarly, in the illustrative embodiment, the I/O subsystem 212 includes a digital-to-analog ("D/A") converter, or the like, that converts digital signals from the processor 210 into analog signals to control operation of the motor 102 of the impact tool 100. It should also be appreciated that, if the motor 102 operates using a digital input signal, the D/A converter may be bypassed.

As discussed above, the impact tool 100 may include any number of sensors 146 configured to sense data that may be used by the controller 202 to determine when to reduce (or increase) the rotational speed of the hammer 122. In some embodiments, the controller 202 monitors sensor data periodically or over predefined intervals to determine whether to reduce, increase, or maintain the rotational speed of the hammer 122. As shown in the illustrative embodiment of FIG. 2, the impact tool 100 may include an inertial sensor 220 (e.g., an accelerometer or gyroscope), an optical sensor 222, a linear encoder 224, and/or a limit switch 226. For example, an inertial sensor 220 may be operably coupled to the impact tool 100 and configured to sense an acceleration of the impact tool 100 or a component thereof (e.g., the drive train 110 or, more particularly, the gear carrier 114). In some embodiments, the inertial sensor 220 may be configured to determine rearward acceleration (i.e., toward the rear end 120) of a component of the impact tool 100 along (or parallel to) the longitudinal axis 116. Although a some amount of acceleration may be normal or acceptable, a significant amount of acceleration (e.g., defined by a threshold acceleration) may indicate that the hammer 122 has suddenly impacted the gear carrier 114, or another portion of the drive train 110, or that the hammer 122 is otherwise behaving erratically. As such, the controller 202 of the impact tool 100 may cause the rotational speed of the motor 102 to be reduced (e.g., via signals transmitted to the motor 102) in response to the acceleration exceeding the threshold acceleration. After a period of relatively stable acceleration (e.g., not exceeding the threshold acceleration), in some embodiments, the rotational speed of the motor 102 may be increased as discussed below with regard to FIG. 3.

In some embodiments, an optical sensor 222 may be operably coupled to the impact tool 100 and configured to sense (directly or indirectly) an absolute or relative location/position of the hammer 122. For example, the optical sensor 222 may sense the distance the hammer 122 has rebounded from the anvil 124 toward the rear end 120 of the impact tool 100. The controller 202 or the optical sensor 222 may determine whether the distance the hammer 122 has rebounded exceeds a threshold distance. Alternatively, the optical sensor 222 may sense that the hammer 122 has reached a predefined location or position of the impact tool 100 (e.g., a position along the camshaft 112). The predefined location may be, for example, a location along the camshaft 112 at which the hammer 122 impacts the drive train 110 or gear carrier 114. It will be appreciated that, in some embodiments, the hammer 122 may be configured to operate within a predefined region (e.g., a region of travel along the camshaft 112) without causing erratic behavior of the impact tool 100 (e.g., axial acceleration of the drive train 110). As such, the predefined location may correspond with a limit or border of that predefined region.

In some embodiments, the impact tool 100 may include a linear encoder 224 to sense or otherwise determine the absolute or relative location or position of the hammer 122 and/or the distance that the hammer 122 has rebounded similar to the optical sensor 222. In various embodiments, the linear encoder 224 may use any suitable mechanisms for doing so (e.g., optical sensing, magnetic sensing, capacitive sensing, inductive sensing, etc.) It should be appreciated that thresholds for the location of the hammer 122 along the camshaft 112, the distance the hammer 122 has rebounded from the anvil 124, and the point at which the hammer 122 causes a rearward axial acceleration of the drive train 110 may be associated with the same location and occurrence in some embodiments. That is, a determination that the hammer 122 has reached a predefined location and has rebounded a predefined distance from impacting the anvil 124 may also indicate that the hammer 122 has impacted the drive train 110 or another component of the impact tool 100 thereby causing unacceptable axial acceleration of that component. In response, the impact tool 100 reduces the rotational speed of the hammer 122 as discussed above. If after some predefined period of time the hammer 122 has not exceeded the threshold distance, reached the predefined location, or exceeded the threshold acceleration (depending on the particular embodiment), the impact tool 100 may increase the rotational speed of the hammer 122.

In another embodiment, a limit switch 226 may be coupled (e.g., electromechanically) to the motor 102 and configured to sense whether the distance the hammer 122 has rebounded exceeds the threshold distance. More specifically, the limit switch 226 may be configured, for example, to make (or break) an electrical connection in response to the hammer 122 reaching a particular location (e.g., the point at which the hammer 122 contacts the gear carrier 114). In some embodiments, the electrical connection may result in modification of the power supplied to the motor 102 (e.g., by changing a load) and may be independent of the controller 202. In other embodiments, the electrical connection may result in electrical signals being transmitted to the controller 202 for analysis. In either case, the limit switch 226 causes a reduction in rotational speed of the motor 102 in response to the hammer 122 reaching the predefined location (similar to the optical sensors 222 and linear encoders 224 discussed above). In yet another embodiment, the controller 202 may monitor the current and/or voltage of the motor 102 to detect erratic operation of the hammer 122. In ordinary operation, the current and/or voltage should stay within a predefined operating range; however, erratic operation may change the load on the motor 102 and thereby modify the current and/or voltage signals.

Figure 3:
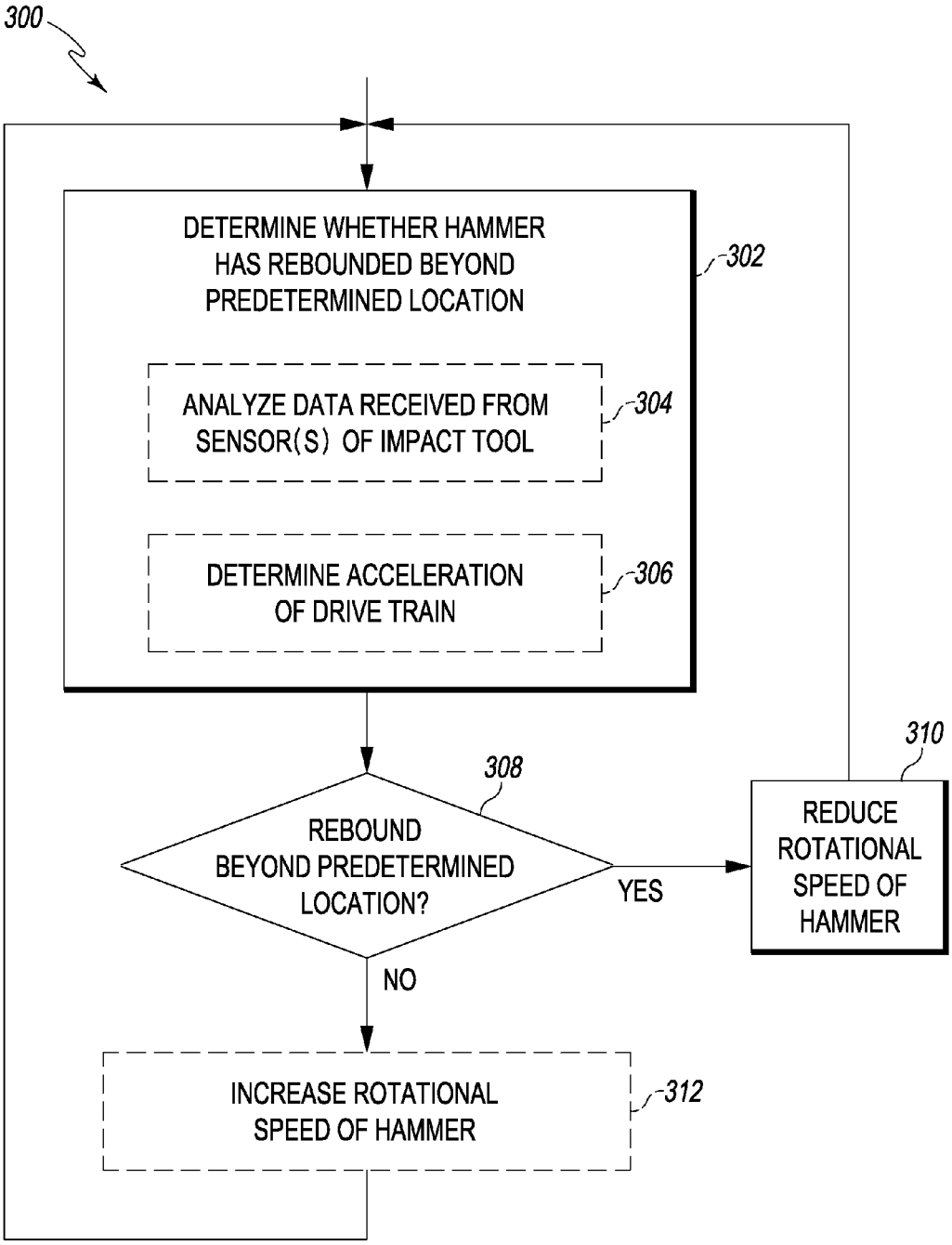
FIG. 3 is a simplified block diagram of one embodiment of a method of operating the impact tool of FIGS. 1A-C.

Referring now to FIG. 3, one illustrative embodiment of a method 300 of operating the impact tool 100 of FIGS. 1A-C is shown as a simplified flow diagram. The method 300 operates the impact tool 100 effectively, while also reducing vibrations in the impact tool 100. The method 300 is illustrated in FIG. 3 as a number of blocks 302-312, which may be performed by various components of the impact tool 100 or, more specifically, of the control system 200 described above with reference to FIG. 2.

As discussed above, the hammer 122 of the impact tool 100 is rotated about the longitudinal axis 116 during operation, which causes the hammer 122 to translate along the longitudinal axis 116 (i.e., via the helical grooves 128 of the camshaft 112), to impact the anvil 124 thereby causing rotation of the anvil 124, and to rebound away from the anvil 124 after each impact. It is contemplated that those operations may be repeated rapidly for tightening or loosening a fastener using the impact tool 100. The method 300 begins with block 302 in which the impact tool 100 determines whether the hammer 122 has rebounded beyond a predetermined location. In doing so, the controller 202 may analyze data received from the sensors 146 of the impact tool 100 in block 304. Further, in block 306, the controller 202 may determine the acceleration of the drive train 110 or other components of the impact tool 100 based on sensed data. As discussed above, the impact tool 100 may determine whether the hammer 122 has rebounded beyond a predetermined location using any suitable mechanism and may make such a determination directly or indirectly (e.g., by measuring the acceleration of the drive train 110). The particular values (i.e., static or dynamic) defining the predetermined location and other threshold values may vary depending on the particular embodiment and the particular sensors 146 used. Further, it will be appreciated that the sensed values may be used to derive other values that may be compared to other threshold values, in some embodiments.

If the impact tool 100 determines in block 308 that the hammer 122 has rebounded beyond the predetermined location, the method 300 proceeds to block 310 in which the impact tool 100 reduces the rotational speed of the hammer 122. As discussed above, the controller 202 may transmit a control signal to the motor 102 to reduce the speed of the motor 102, thereby reducing the rotational speed of the hammer 122. In other embodiments, the impact tool 100 may more directly reduce the rotational speed of the hammer 122 (e.g., by use of a limit switch 226, via mechanical dampening or braking, or using another suitable mechanism). After block 310, the method 300 returns to block 302.

If, however, the impact tool 100 determines in block 308 that the hammer 122 has not rebounded beyond the predetermined location, the method 300 proceeds to block 312 in which the impact tool 100 may increase the rotational speed of the hammer 122. As discussed above, the impact tool 100 may do so if the hammer 122 has not rebounded beyond the predetermined location for a predetermined period of time (i.e., if the hammer 122 is no longer causing erratic operation). In some embodiments, the impact tool 100 only determines whether to increase the rotational speed of the hammer 122 after having previously decreased the rotational speed of the hammer 122 (e.g., from the peak speed). However, in other embodiments, the impact tool 100 may continuously or periodically make such a determination even without having previously reduced the rotational speed of the hammer 122. For example, in some embodiments, the impact tool 100 may employ the method 300 to "ramp up" the rotational speed of the hammer 122 (e.g., upon startup) until erratic operation occurs and then reduce the rotational speed to a stable operating point. After block 312, the method 300 returns to block 302. As indicated above, it is contemplated that the method 300 may be repeated rapidly in some embodiments.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

an impact mechanism comprising a hammer and an anvil, the hammer being configured to rotate about an axis and to translate along the axis to impact the anvil to cause rotation of the anvil about the axis;

a motor;

a drive train configured to transfer rotation from the motor to the hammer of the impact mechanism;

an inertial sensor configured to sense an acceleration of the drive train along the axis;

an electronic controller operably coupled to the motor and to the inertial sensor, the electronic controller being configured to decrease a rotational speed of the motor in response to determining that the acceleration of the drive train along the axis has exceeded a threshold acceleration; and one or more ball bearings couple the hammer to a camshaft for rotation therewith and the inertial sensor is coupled to the camshaft.

2. The impact tool of claim 1, wherein the inertial sensor is coupled to the drive train.

3. The impact tool of claim 2, wherein the inertial sensor is coupled to a ring gear holder of a planetary gear set of the drive train.

4. The impact tool of claim 1, wherein the electronic controller is configured to determine whether the hammer has impacted the drive train based on the acceleration of the drive train along the axis.

5. The impact tool of claim 1, wherein the electronic controller is further configured to increase the rotational speed of the motor in response to determining that the acceleration of the drive train along the axis has not exceeded the threshold acceleration for a predetermined period of time.

6. The impact tool of claim 1, wherein the electronic controller is configured to determine whether the acceleration of the drive train along the axis has exceeded the threshold acceleration on a periodic basis.

7. An impact tool comprising:

an impact mechanism comprising a hammer and an anvil, the hammer being configured to (i) rotate about an axis, (ii) translate along the axis in a first direction to impact the anvil to cause rotation of the anvil about the axis, and (iii) rebound in a second direction, opposite the first direction, as a result of the impact;

a motor configured to drive rotation of the hammer of the impact mechanism;

a position sensor configured to sense a position of the hammer along the axis;

an electronic controller coupled to the motor and to the position sensor, the electronic controller being configured to decrease a rotational speed of the motor in response to the hammer rebounding beyond a predetermined location along the axis; and one or more ball bearings that couple the hammer to a camshaft for rotation therewith and the inertial sensor is coupled to the camshaft.

8. The impact tool of claim 7, further comprising a spring configured to bias the hammer toward the first direction.

9. The impact tool of claim 8, wherein the predetermined location along the axis corresponds with a predetermined amount of compression of the spring.

10. The impact tool of claim 9, wherein the hammer is configured to rebound beyond the predetermined location along the axis when a rebound force applied to the spring by the hammer exceeds a biasing force applied to the hammer by the spring with the predetermined amount of compression.

11. The impact tool of claim 7, wherein the electronic controller is configured to determine the location of the hammer relative to the predetermined location along the axis based on the sensed position of the hammer.

12. The impact tool of claim 7, further comprising a drive train configured to transfer rotation from the motor to the hammer, wherein the predetermined location along the axis corresponds with a location at which the hammer impacts the drive train.

13. An impact tool comprising:

an impact mechanism comprising a hammer and an anvil, the hammer being configured to rotate about an axis and to translate along the axis to impact the anvil to cause rotation of the anvil about the axis;

a motor;

a drive train configured to transfer rotation from the motor to the hammer of the impact mechanism;

an inertial sensor configured to sense an acceleration of the drive train along the axis; and an electronic controller operably coupled to the motor and to the inertial sensor, the electronic controller being configured to decrease a rotational speed of the motor in response to determining that the acceleration of the drive train along the axis has exceeded a threshold acceleration;

wherein the inertial sensor is coupled to the drive train and is coupled to a ring gear holder of a planetary gear set of the drive train.

* * * * *